United States Patent [19]

Baron

[11] 4,233,689

[45] Nov. 18, 1980

[54] PROTECTIVE HEADGEAR

[76] Inventor: Stephen H. Baron, 3967 Eureka Dr., Studio City, Calif. 91604

[21] Appl. No.: 890,242

[22] Filed: Mar. 27, 1978

[51] Int. Cl.[2] ..... A42B 3/00; A63B 69/02

[52] U.S. Cl. ..... 2/413; 2/425; 2/9

[58] Field of Search ..... 2/9, 410, 411, 413, 2/424, 425; 272/98

[56] References Cited

U.S. PATENT DOCUMENTS

| | | | |
|---|---|---|---|
| 802,505 | 10/1905 | Goldsmith | 2/9 |
| 2,121,702 | 6/1938 | Larkin | 2/413 |
| 2,262,449 | 11/1941 | Buegeleisen | 2/9 |
| 2,362,597 | 11/1944 | Vince | 2/9 |
| 2,525,389 | 10/1950 | Zeller | 2/9 |
| 2,594,478 | 4/1952 | Moore | 2/413 |
| 3,527,461 | 9/1970 | Prater | 2/9 |
| 3,878,563 | 4/1975 | Pulda | 2/9 |
| 4,124,904 | 11/1978 | Matthes | 2/413 |

*Primary Examiner*—Louis Rimrodt
*Attorney, Agent, or Firm*—Lyon & Lyon

[57] ABSTRACT

Disclosed herein is a protective device for the head which is particularly adapted for use in learning the art of self-defense and for training in the martial arts. The device is comprised of an inner transparent shell and a pair of flexible sheets of transparent material secured and disposed about the inner shell forming a transparent inflatable shock absorbing air chamber about the inner shell. When used in the martial arts, a plurality of pressure activated switches are provided in the inner shell at locations corresponding to vital target areas. When one of the switches is struck by a blow of sufficient force and at a given angle, the switch is closed and a light source carried by the shell is illuminated.

10 Claims, 5 Drawing Figures

FIG. 4b.
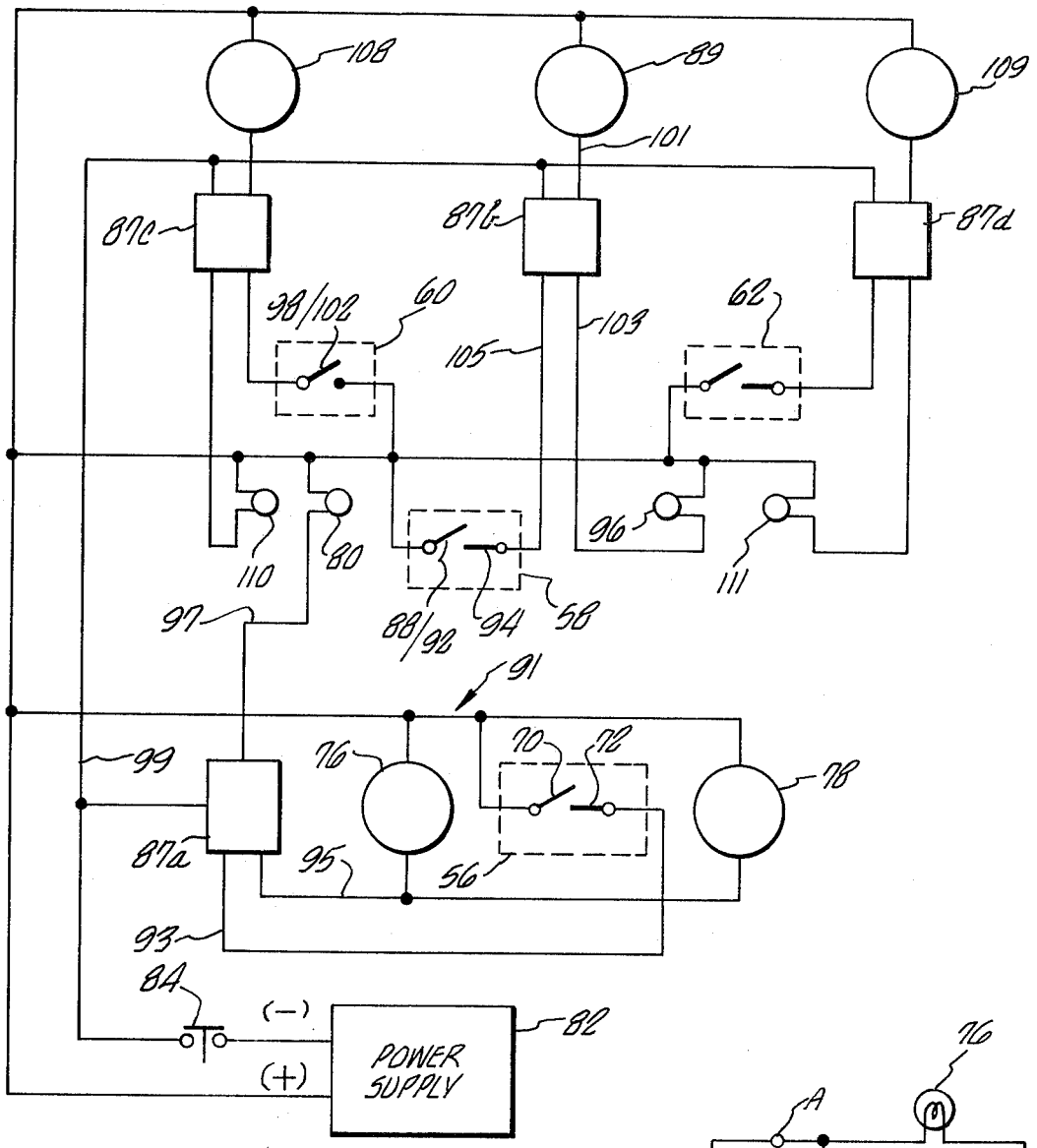
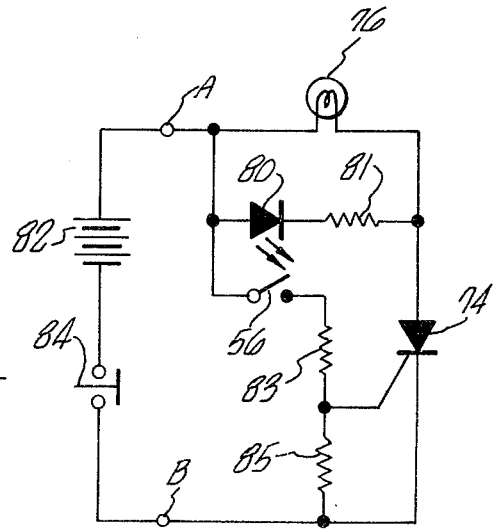
FIG. 4a.

PROTECTIVE HEADGEAR

BACKGROUND OF THE INVENTION

In recent years there has been an increased emphasis on safety in most activities of human endeavor, including sports. This emphasis in the area of sports-related activities has resulted in the design and manufacture of a large number of different types of protective headgear. Many new types of football and motorcycle helmets have been developed as well as protective headgear for boxers, hockey players, surfers, skateboarders, etc. Each of these different devices is designed in an attempt to give a maximum amount of protection for a particular type of use. However, an area of conflict always arises in balancing the protection of the wearer's face against visibility and one is often sacrificed at the expense of the other.

A boxer's headgear while protecting the head and affording maximum visibility provides no protection for the wearer's face. Similarly, a football helmet in an effort to provide some facial protection employs a face mask at the sacrifice of some degree of visibility. A motorcycle helmet while perhaps adequately protecting the wearer's head, affords little or no protection to the wearer's face and no suitable headgear has heretofore been developed for protecting an individual when practicing or participating in the martial arts wherein excellent visibility is highly important and the majority of blows are directed toward the particular location on the opponent's face as opposed to the head in general. Accordingly, for many different usages and in particular for learning the skills of self defense and development in the martial arts it would be highly desirable to provide headgear which affords excellent protection for the wearer's head without impairing his vision. The headgear disclosed herein provides such protection.

SUMMARY OF THE INVENTION

Briefly, the present invention comprises protective headgear which while being highly suitable for a number of uses is particularly adapted for use in learning the art of self-defense and for use in the martial arts. The device includes a rigid transparent inner shell and a pair of flexible sheets of transparent material which are secured to and disposed about the inner shell forming a transparent inflatable shock absorbing air chamber about a portion of the wearer's head and face. When used in the martial arts, a plurality of pressure activated switches are provided on the inner shell at locations corresponding to vital target areas. When one of the switches is struck by a properly directed blow of sufficient force, the switch is closed and a light source carried by the shell is activated. In this manner, the protective device registers the execution of a proper blow while protecting the wearer from injury.

It is the primary object of the present invention to provide protective headgear which is superior to those devices heretofore available.

It is another object of the present invention to provide protective headgear for protecting the wearer's head and face without impairing his vision.

It is another object of the present invention to provide protective headgear which will absorb the shock of a blow to the wearer's face.

It is a further object of the present invention to provide protective headgear for use in the martial arts which protects the wearer's head, face and throat without obstructing his vision.

It is a still further object of the present invention to provide protective headgear for use in the martial arts which absorbs the shock of blows directed to the face and throat and includes means for indicating a properly delivered blow.

Another object of the present invention is to provide protective headgear for use in the martial arts which can be struck by a combatant's hand and fingers without damaging the same.

It is still another object of the present invention to provide transparent headgear for protecting the wearer's head and face which resists fogging.

These and other objects and advantages of the present invention will become apparent from the following detailed description taken in conjunction with the accompanying drawings.

DESCRIPTION OF THE PREFERRED EMBODIMENT

IN THE DRAWINGS

Figure 1:
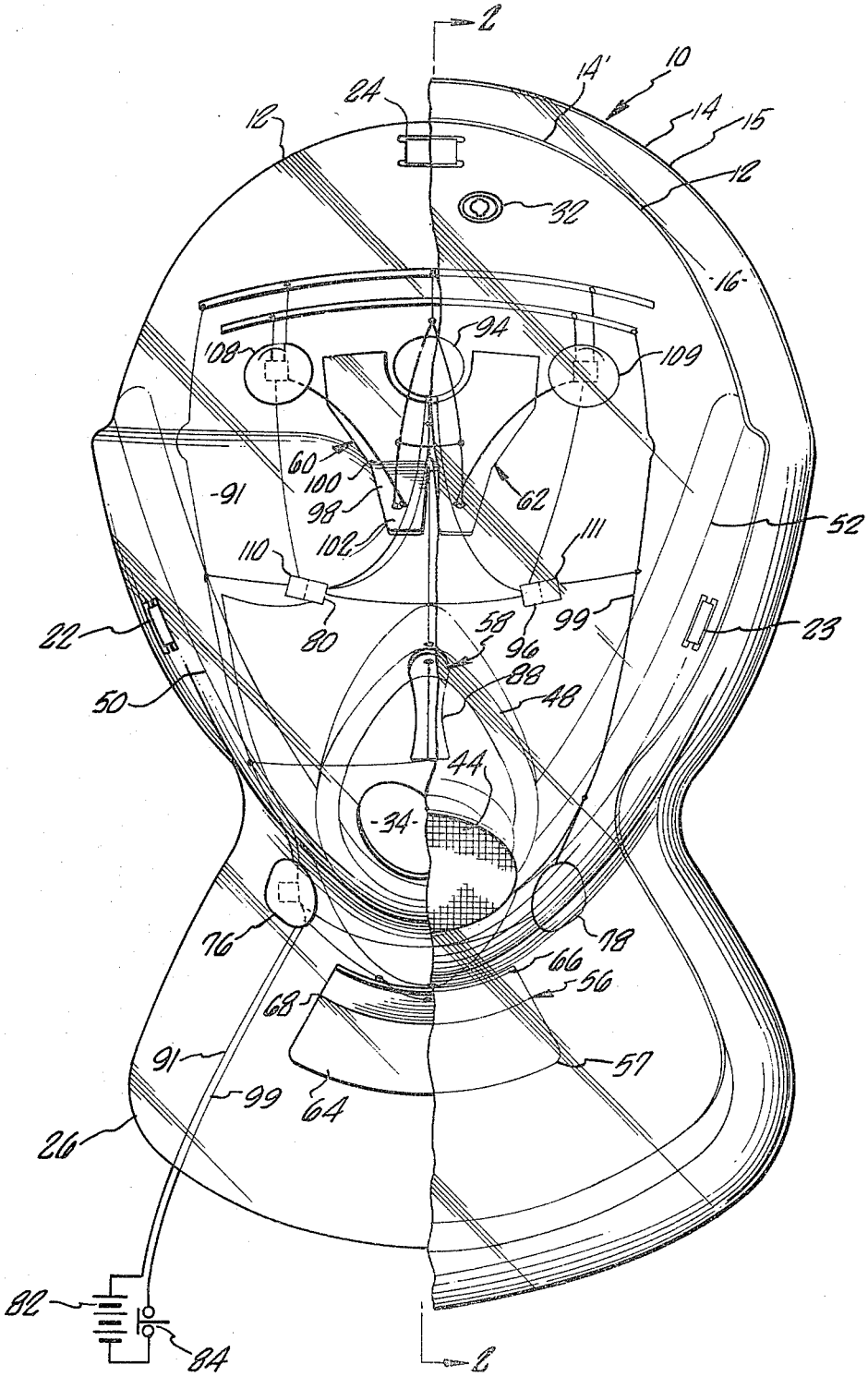
FIG. 1 is a frontal view of the protective headgear with a portion of the outer flexible sheet of transparent material which forms the shock absorbing chamber removed.

FIG. 4*a* illustrates the circuitry for illuminating one of the light sources on the protective headgear upon the delivery of a properly executed blow.

FIG. 4*b* illustrates a schematic view of a plurality of circuits as shown in FIG. 4*a*.

Referring now in detail to the drawings, the protective headgear 10 is comprised of a lightweight transparent inner rigid shell 12 which is preferably constructed of a durable plastic material and a pair of outer flexible sheets 14 and 14' of transparent material such as pin hole free vinyl defining an air tight bag 15, which is secured to and disposed about the inner shell 12 to form an inflatable shock absorbing chamber 16. The inner shell 12 has a contour similar to the wearer's head and face (illustrated in phantom lines in FIG. 2), so as to fit thereabout and is open at the backside 18 thereof. An elastic strap 20 extends across the open backside of the shell and is fastened to the sides and upper rearward portion thereof at 22, 23 and 24 for securing the shell and headgear about the wearer's head and face.

In the embodiment of the invention illustrated in the drawings wherein the headgear is adapted in training in the martial arts, the rigid shell 12 is provided with an extended skirt portion 26 which can be integrally formed with the head portion of the shell and extends downwardly from the lower portion thereof covering the wearer's throat and neck. Similarly, the flexible sheets 14 and 14' which together with the inner shell forms the inflatable shock absorbing chamber 16, extends over the skirt portion to correspondingly extend the protection afforded the wearer by the shock absorbing chamber 16.

Figure 2:
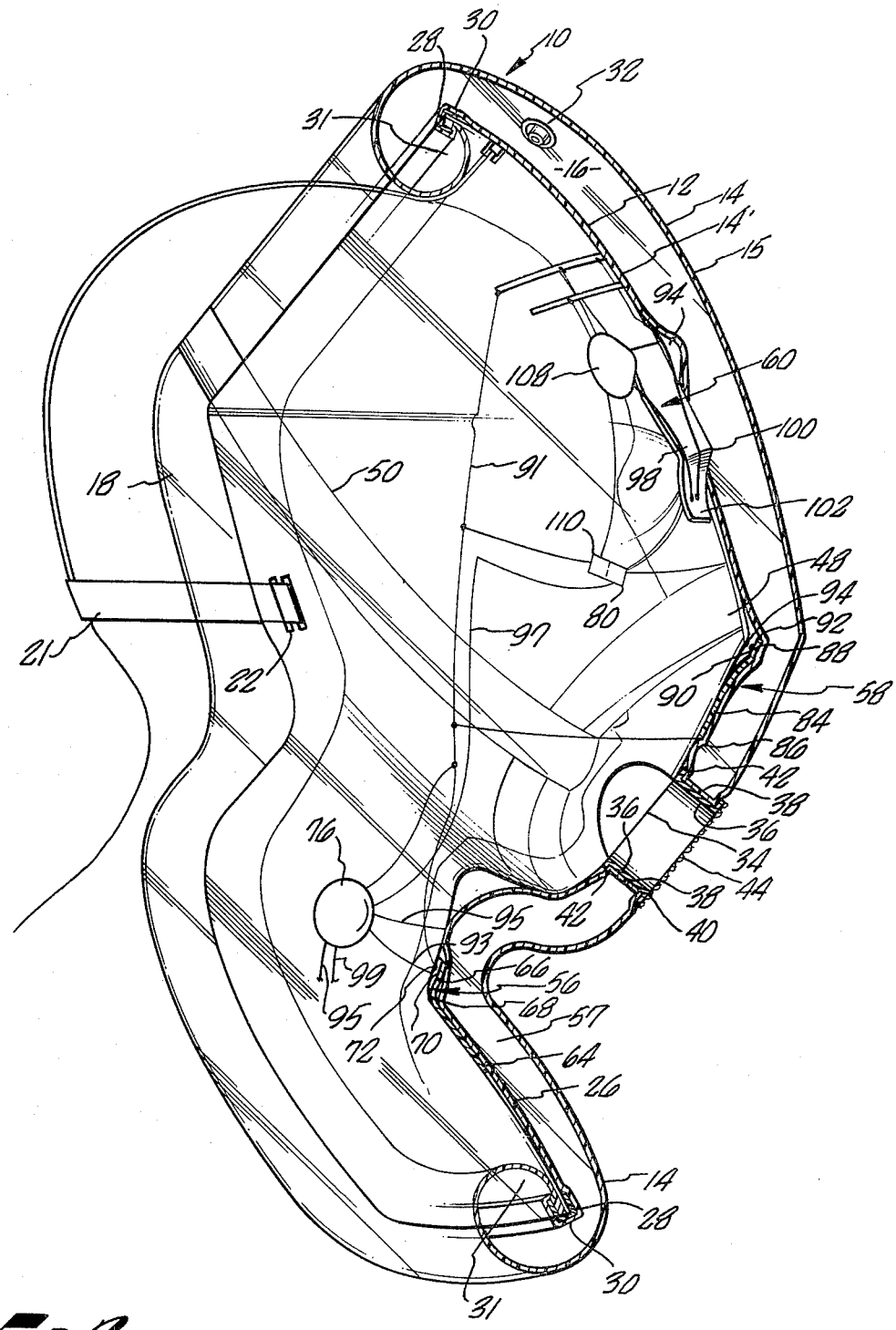
FIG. 2 is a sectional view taken along line 2—2 of FIG. 1.

As best seen in FIG. 2, the outer transparent flexible sheets 14 and 14' extend about and are secured to the inner rigid shell 12 along the perimeter edge 28 thereof by means of a flexible channel locking member 30 which secures the bag 15 in place about the rigid shell and forms a perimeter cushion 31 for spacing the inner shell from the wearer's head and body. A separate U-shaped channel member could also be employed to form this seal and define the perimeter cushion 31. While other fastening means could be employed, by securing the sheets 14 and 14' to the shell 12 continuously along the perimeter edge thereof in the manner illustrated, the entire surface of the shell is protected by the formed chamber. A valve 32 is provided in the outer sheet 14 so that the chamber 16 within bag 15 which is defined by sheets 14 and 14' can be filled with air and thereby function as a shock absorbing chamber. In this manner, not only is the wearer's face and head shielded from direct contact but the force of the blow or other contact delivered to the headgear is substantially absorbed by the air filled chamber and not transmitted directly to the wearer.

In an alternate embodiment of the invention (not shown), a single outer transparent sheet 14 could be employed which is secured by the channel locking member 30 to the inner shell 12, making an air tight seal between the shell and outer sheet and thereby defining the shock absorbing chamber 16 therebetween.

To prevent fogging of the inner shell 12 while breathing, an aperture 34 is provided in the shell opposite the location of the wearer's mouth. In order to seal the flexible sheets 14 and 14' about the breathing aperture 34 and prevent fogging of the outer sheet, a cylindrical wall 36 is affixed to the inner shell 12 about the breathing aperture 34 as illustrated in FIG. 2. The outer sheets 14 and 14' define an annular wall portion 38 which tightly abuts the cylindrical wall 36 of the inner shell and seals the shock absorbing chamber 16 from the breathing aperture 34. A pair of small annular flanges 40 and 42 are provided at the inner and outer ends respectively of the cylindrical wall 36 to assist in holding the outer flexible sheets 14 and 14' in place. A screen 44 constructed of a nylon material or the like is disposed across flange 42 to prevent one's fingers from entering the breathing aperture during martial arts training. In the preferred construction of the headgear, a ring 48 of soft sponge-like material is secured to the interior side of the inner shell about the breathing aperture to provide some additional shock absorption between the inner shell and the wearer's face and isolate the breathing aperture from the interior of the headgear. If necessary, a pair of air tubes 50 and 52 could be secured to the inner shell and extended from the upper edge thereof into the breathing area 56 defined by ring 48 about the breathing aperture 34 to further reduce the possibility of fogging the interior of the headgear. To accommodate the upper ends of air tubes 50 and 52, a pair of annular wall portions could be provided in the outer sheets 14 and 141 similar to wall portion 38 which accommodates the breathing apparatus 34.

In addition to protecting the wearer's head and face from the force of a blow delivered to the headgear, when used for training in the martial arts the air chamber 16, by absorbing a large amount of the force of the blow, similarly protects the hands and fingers of the person delivering the blow. Thus by using the headgear 10 of the present invention one can effectively practice actual blows of the martial arts against another person without risk of injury to either of the participants and in this way greatly accelerate their development in the martial arts.

To further enhance this embodiment, the headgear 10 is provided with a plurality of pressure actuated switches, 56, 58, 60 and 62 which are positioned at areas on the headgear corresponding to what could be termed vital or disabling points, in that if a properly executed blow were delivered to one of those points, an assailant or an opponent would be immediately disabled. Those locations correspond to the wearer's larynx, the underside of the nose and the eyes. Upon proper execution of a blow to one of those areas, the switch is closed and a corresponding light source is illuminated. Each of the switches is carried by the inner shell behind the shock absorbing chamber 16 as seen in FIG. 2. As will be discussed, each switch is constructed such that the force of a blow necessary to close the switch corresponds to the force actually needed to deliver a disabling blow to the particular area. In addition, as will be described, the switch located over the wearer's nose is so constructed that a blow to the nose must not only be of sufficient force but be delivered at the proper angle as well or the switch will not close.

Switch 56 which is located on the headgear over the wearer's larynx is of an arcuate configuration and is comprised of a plate 57 preferably constructed of the same material as the inner shell 12 and has a base portion 64 and a tab portion 66 which curves outwardly therefrom at 68. The base portion of the plate 57 has the same contour as shell 12 and is affixed thereto by a suitable adhesive or other fastening means. A first contact member 70 is provided on the inner side of the tab portion 66 of the switch and a second contact member 72 is carried by the inner shell 12 inwardly of and spaced from the first contact member 70. As is apparent from FIG. 2, a blow delivered to the headgear at the location of switch 56 which is of sufficient force and direction to flatten the air chamber 16 and bend the tab portion 66 of plate 57 will bring the contact member 70 carried by the tab portion into electrical contact with member 72 carried by the inner shell 12 and, as illustrated in the circuit diagram of FIG. 4*a*, trigger the SCR 74 thereby closing the circuit and illuminating the external light indicators 76 and 78 and an internal light indicator 80. The external indicators 76 and 78 will indicated to the person delivering the blow that it was properly executed and the internal indicator 80 which is preferably an LED will indicate the proper execution of the blow to the wearer of the headgear. For switch 56 to close, the blow must have a force of at least 10 pounds per square inch which corresponds to the force necessary to disable a person by means of a blow to the larynx.

As seen in FIGS. 1 and 2, external indicators are mounted on the inner shell 12 in the area of switch 56 and the internal indicator is positioned on the interior shell below the wearer's eyes where it is clearly visible. The circuitry associated with switch 56 is illustrated in FIGS. 4*a*–4*b* and the actual wiring which is carried by and secured to the inner shell is seen in FIGS. 1 through 3, and 4*b*. The power source 82 which has been successfully employed is comprised of a pair of 9 volt batteries connected in a series. A normally closed momentary open switch 84 is provided to reset the circuit and turn off the light indicators after a properly executed blow has been so indicated.

While the indicator circuitry shown in FIG. 4*a* is explained herein in connection with switch 56, located at the wearer's larynx, and the associated light indicators 76, 78 and 80, it is to be understood that the circuitry associated with the remaining pressure actuated switches 58, 60 and 62 varies only as to the number of indicators used and is connected to the power source and reset switch at terminals "A" and "B" as indicated on FIG. 4*a*. This of course means that only a single power source 82 and reset switch 84 is required for a plurality of indicator circuits. This feature may be better appreciated from FIG. 4*b*, which illustrates a preferred arrangement of the switches, indicators and remaining indicator activating circuitry.

Turning to the particular indicator circuit of FIG. 4*a*, the negative terminal of the power source 82 is connected in series with the reset switch 84. The positive terminal of the power source 82 is connected to the terminal "A" as well as the light indicator 76, the anode of an LED 80, and one terminal of the switch 56. If desired, other indicators similar to the light indicator 76 may be connected in parallel therewith. The LED 80, in combination with an associated current-limiting resistor 81, is also connected in parallel with the light or similar indicator 76. The remaining terminal of the indicator 76 is connected to the anode of the SCR 74, the cathode of which is connected to the remaining terminal of the reset switch 84. The trigger terminal of the SCR 74 is connected to the junction of resistors 83 and 85, the remote terminal of the resistor 83 being connected to the remaining terminal of the switch 56 and the remaining terminal of the resistor 85 being connected to the cathode of the SCR 74.

During training, a blow of the proper force causes the switch 56 to close. This closure triggers the SCR 74, causing indicator 76 and LED 80 to be activated. After the switch 56 reopens, the SCR 74 causes the indicator 76 and the LED 80 to remain lit until the reset switch 84 is opened, breaking the circuit between the power supply 82 and the SCR 74.

Referring to FIG. 4*b*, an exemplary arrangement of the switches, indicators and indicator activating circuits of FIG. 4*a* is shown suitable for placement within the headgear. Preferably, each indicator activating circuit 87*a–d* is located substantially contiguously with its associated indicators, as for example, indicator activating circuit 87*a* and associated indicator 76. It will be understood that each of the circuits 87*a–d* comprises the circuitry of FIG. 4*a*, less the switch and indicators, which are shown separately. Each pressure activated switch communicates with its associated indicator and activating circuit by means of appropriate conductors. For example, switch 56 communicates with the power supply 82 through a conductor 91 and communicates with the circuit 87*a* through a conductor 93. The circuit 87*a* communicates with the indicators 76, 68 and 80 through conductors 95 and 97, the remaining terminals of these indicators being tied to the bus 91. The circuit 87*a* is tied to the negative supply terminal through a bus 99.

Similarly, the circuit 87*b* communicates with its associated indicator 89 through a bus 101, communicates with LED 96 via bus 103, and communicates with the switch 58 via bus 105. The remaining terminals of each of the elements are connected to the appropriate power supply buses 91 and 99. Indicator activating circuits 87*c*–87*d* operate to activate their associated indicators 108 and 110, and 109 and 111, respectively, in an entirely analogous manner and will therefore not be described in detail.

Figure 3:
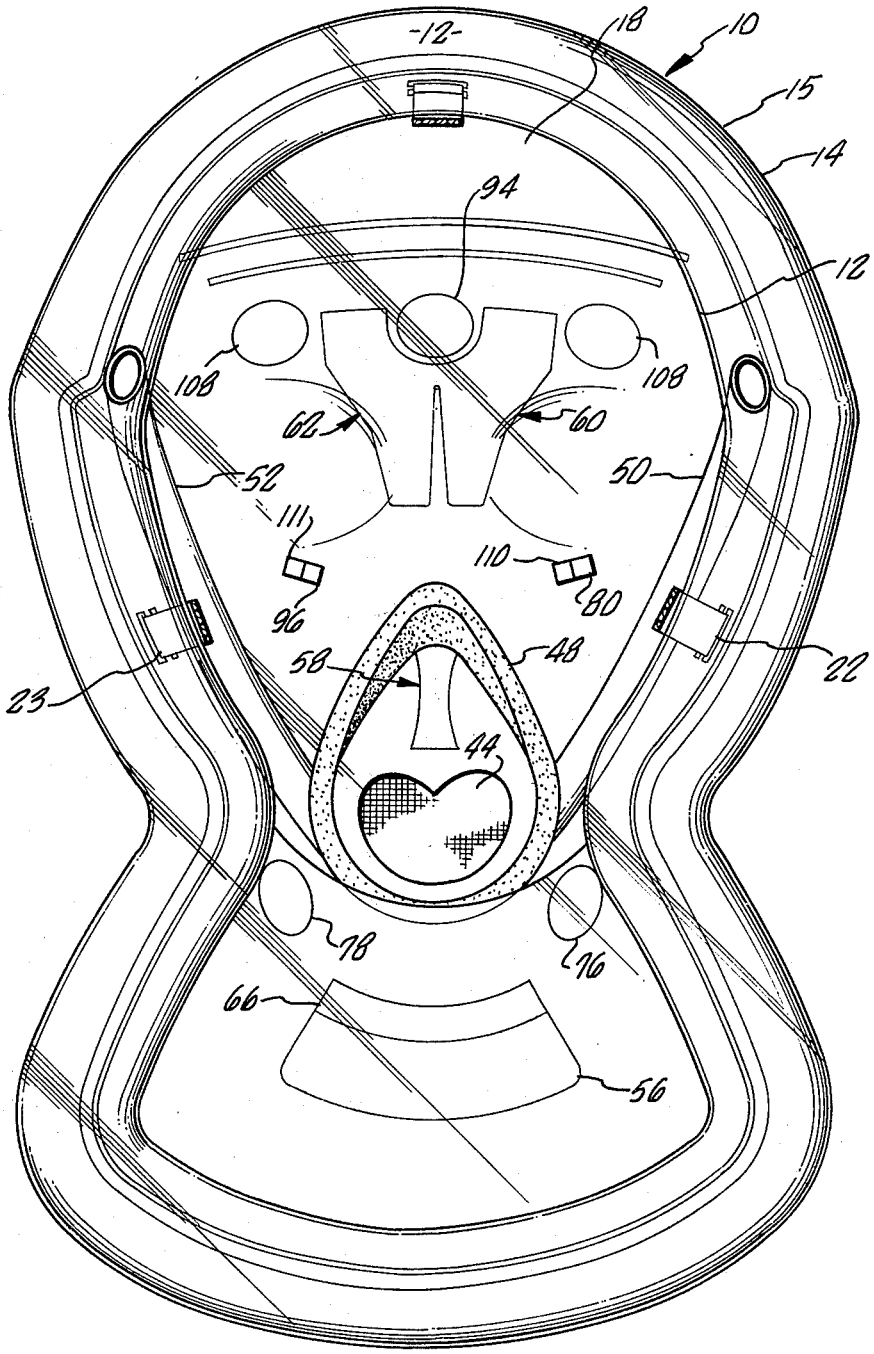
FIG. 3 is a rear view of the protective headgear.

It will be understood that the circuit diagram of FIG. 4*b* is arranged to substantially correspond to the actual placement within the protective headgear shown in FIGS. 1–3 of the various switches, indicators, conductors and remaining circuitry. However, many variations of this arrangement not departing from the spirit of the present invention will be apparent to those skilled in the art.

Switch 58 which is located on the headgear over the wearer's nose is comprised of an elongated member 84 which is secured at its lower end 86 to the inner shell 12 and defines an extended upper tab portion 88 which is bent outwardly at 90 and simulates the underside of an assailant's nose. A first contact member 92 is provided on the inner side of the tab portion 88 and a second contact member 94 is carried by the inner shell 12 and is spaced inwardly from and slightly above contact member 92 such that if a horizontal force were to strike the switch 58, the force bending movement of the elongate member 84 would be such that the contact member 92 carried thereby would move under the contact member on the inner shell and electrical contact would not be made. However, if the force were directed upwardly at an angle of about 45 to 50 degrees, and preferably at 47 degrees with respect to the horizontal plane, and if the force was of at least 40 pounds per square inch, the air chamber 16 would be flattened at that point and the elongate member 84 would be sufficiently deformed to move upwardly during its inward movement to make electrical contact with contact member 94 and illuminate an exterior light source 89 and an interior light source 96. Through this construction, switch 58 is only closed upon being struck by a blow which would be immediately disabling if delivered to the underside of an assailant's nose, i.e., at about 47 degrees to the horizontal and at a force of at least 40 pounds per square inch.

The circuitry associated with switch 58 is the same as that associated with switch 56 except that only one exterior light source is provided and, accordingly, is as illustrated in FIG. 4*a*. The actual wiring arrangement for the circuitry switch and indicators may be seen from FIG. 4*b*.

Switches 60 and 62 are disposed on the headgear over the wearer's eyes. As these switches and associated circuitry are substantially identical, only one need be described in detail. Switch 60 is comprised of an elongate member 98 which is secured at its upper end to the inner shell 12 and is bent outwardly at 100 to define a tab portion 102 which simulates an assailant's eyes. As with the previously described switches, a first contact member (not shown) is carried by the tab portion of switch 60 and a second contact member (also not shown) is mounted on the inner shell 12 spaced from the first contact member such that upon a blow being delivered by a person's fingers to the headgear of sufficient strength to depress the air chamber 16 and close switch 60 an external indicating light 108 is illuminated as well as an internal LED 110. Switch 62 activates external indicating light 109 and in internal LED 111 in the same manner. Again, the circuitry associated with switches 60 and 62 is the same illustrated in FIG. 4*a* and, as with switch 56, a force of 10 pounds per square inch is required.

Various changes and modifications may be made in carrying out the present invention without departing from the spirit and scope thereof. Insofar as these changes and modifications are within the purview of the appended claims, they are to be considered as part of the invention.

I claim:

1. Protective headgear for protecting the wearer's head and face, said headgear comprising a transparent inner shell adapted to fit over the wearer's face, an outer sheet of transparent material extending over said inner shell and about the perimeter portion thereof and being sealably secured to said inner shell along the perimeter portion thereof defining an air tight chamber about said inner shell, a portion of said chamber extending about and inwardly of the perimeter portion of said inner shell, valve means for inflating said chamber to render said chamber shock absorbing, and means for securing said inner shell and outer sheet on the wearer's head.

2. The combination of claim 1 wherein said inner shell and outer sheet include downwardly extending skirt portions such that said chamber extends over the wearer's throat upon securing said inner shell and outer sheet on the wearer's head.

3. The combination of claim 1 including axially lined breathing apertures in said inner shell and said outer sheet and means carried by said inner shell communicating the interior area about the breathing aperture in said inner shell with the atmosphere for reducing fogging on said inner shell.

4. The combination of claim 1 including a second sheet of transparent material disposed between said inner shell and said outer sheet, said second sheet and said outer sheet being secured to the perimeter portion of said inner shell and defining said airtight chamber.

5. Protective headgear comprising a transparent inner shell adapted to fit over the wearer's face, an outer sheet of transparent material sealably secured to said inner shell and defining an air tight chamber about said inner shell, valve means for inflating said chamber to render said chamber shock absorbing, means for securing said inner shell and said outer shell on the wearer's head, switch means carried by said inner shell and light indicating means in electrical contact with said switch means such that upon striking said switch means with sufficient force to close said switch means, said light indicating means are activated.

6. The combination of claim 5 wherein said inner shell defines a contour generally corresponding to that of the wearer's face and said switch means are provided on said inner shell at locations corresponding to the positioning of the wearer's eyes and nose, the switch means provided at the location of the wearer's nose being activated solely by an upwardly directed force.

7. The combination of claim 6 wherein said upwardly directed force is within the range of 45 to 50 degrees with respect to the horizontal.

8. The combination of claim 6 wherein the force necessary to close the switch means assimulating the wearer's eyes is at least about 10 pounds per square inch and the force necessary to close the switch assimulating the wearer's nose is at least about 50 pounds per square inch.

9. Self-defense training apparatus comprising a body member, at least a portion thereof defining a contoured generally corresponding to a human head, switch means provided on said body locations corresponding to the positioning of the eyes and nose of the head, the switch means provided at the location corresponding to the positioning of the nose being activated solely by an upwardly directed force, and means carried by said body member and in electric contact with said switch means for indicating the closing of said switch means.

10. A combination of claim 9 wherein the switch means provided at the location corresponding to the positioning of the eyes is activated solely by a force of at least 10 pounds per square inch and the switch means provided at the location corresponding to the positioning of the nose is activated solely by an upwardly directed force of at least 40 pounds per square inch and within the range of 45° to 50° with respect to the horizontal.

* * * * *